US009040885B2

(12) United States Patent
Morris et al.

(10) Patent No.: US 9,040,885 B2
(45) Date of Patent: May 26, 2015

(54) TRAJECTORY MODIFICATION OF A SPINNING PROJECTILE

(75) Inventors: Joseph P. Morris, Bothell, WA (US); Douglas L. Smith, Bellevue, WA (US)

(73) Assignee: General Dynamics Ordnance and Tactical Systems, Inc., St. Petersburg, FL (US)

( * ) Notice: Subject to any disclaimer, the term of this patent is extended or adjusted under 35 U.S.C. 154(b) by 459 days.

(21) Appl. No.: 12/617,634

(22) Filed: Nov. 12, 2009

(65) Prior Publication Data

US 2012/0211593 A1 Aug. 23, 2012

Related U.S. Application Data

(60) Provisional application No. 61/113,991, filed on Nov. 12, 2008.

(51) Int. Cl.
*F42B 15/01* (2006.01)
*F42B 10/54* (2006.01)
*F42B 10/62* (2006.01)

(52) U.S. Cl.
CPC ..... *F42B 10/54* (2013.01); *F42B 10/62* (2013.01)

(58) Field of Classification Search
CPC ..... F42B 10/52; F42B 10/06; F42B 10/64; F42B 10/14; F42B 10/62
USPC ..... 244/3.15, 3.22, 3.23, 3.24, 3.27, 3.28
See application file for complete search history.

(56) References Cited

U.S. PATENT DOCUMENTS 3,790,104 A * 2/1974 Jones ..... 244/3.27
4,565,340 A * 1/1986 Bains ..... 244/3.28
4,964,593 A * 10/1990 Kranz ..... 244/3.24
4,989,517 A * 2/1991 Adimari et al. ..... 102/388
5,083,724 A * 1/1992 Kranz ..... 244/3.21
5,393,012 A * 2/1995 Dunn ..... 244/3.23
5,417,393 A * 5/1995 Klestadt ..... 244/3.27
5,425,514 A * 6/1995 Grosso ..... 244/3.22
5,452,864 A * 9/1995 Alford et al. ..... 244/3.23
6,135,387 A * 10/2000 Seidel et al. ..... 244/3.15
6,283,407 B1 * 9/2001 Hakenesch ..... 244/3.21
6,502,786 B2 * 1/2003 Rupert et al. ..... 244/3.27
6,648,433 B2 * 11/2003 Kusic ..... 244/3.23
6,748,871 B2 * 6/2004 Hellman ..... 102/490
7,163,176 B1 * 1/2007 Geswender et al. ..... 244/3.27
7,267,298 B2 * 9/2007 Leininger ..... 244/3.24
7,354,017 B2 * 4/2008 Morris et al. ..... 244/3.23

(Continued)

*Primary Examiner* — Valentina Xavier

(74) *Attorney, Agent, or Firm* — Joseph R. Englander; Shutts & Bowen LLP

(57) ABSTRACT

The invention is a projectile, device and system having a roll control device which may be fixed or deployable, for providing torque counter to the spin of the projectile and providing drag on the projectile. The roll control device includes a guidance collar rotatably attached to the projectile located near a front end of the projectile wherein the guidance collar includes one or more guidance collar aero-surfaces shaped to provide torque counter to the spin on the projectile. The guidance collar aero-surfaces may be controlled by a brake and guidance electronics on the projectile. The invention also includes a body collar fixedly attached to the projectile aft of the guidance collar, wherein the body collar includes one or more body collar aero-surfaces and fixed or deployable drag devices. Another embodiment use only a guidance collar aero-surfaces to orient a fixed drag device relative to an Earth inertial reference frame to create asymmetrical drag on the projectile and thereby altering its trajectory.

29 Claims, 7 Drawing Sheets

(56) References Cited

U.S. PATENT DOCUMENTS 7,412,930 B2 * 8/2008 Smith et al. ..... 102/473
8,026,465 B1 * 9/2011 Fraysse, Jr. ..... 244/3.22
2003/0037665 A1 * 2/2003 Rupert et al. ..... 89/1.8
2004/0094661 A1 * 5/2004 Johnsson et al. ..... 244/3.27
2004/0164202 A1 * 8/2004 Klestadt et al. ..... 244/3.24
2005/0150999 A1 * 7/2005 Ericson et al. ..... 244/3.24

* cited by examiner

200

TRAJECTORY MODIFICATION OF A SPINNING PROJECTILE

CROSS-REFERENCE TO RELATED APPLICATION

This application relates to the same subject matter as co-pending provisional patent application Ser. No. 61/113,991, filed by the same applicant on Nov. 12, 2008. This application claims the Nov. 12, 2008 filing date as to the common subject matter.

BACKGROUND OF THE INVENTION

1. Field of the Invention

The disclosure relates generally to projectiles and, more specifically, to an apparatus, method and system for controlling the spin and/or orienting the guidance section of a projectile.

2. Description of the Related Art

The optimization of two dimensional course correction for a projectile requires a solution that is effective, has low cost, weight and power consumption. This is true for the design of a new projectile as well as the retrofit of an existing one.

One embodiment of this invention provides trajectory control by manipulation of the projectile's yaw of repose and manipulation of its drag allowing the effective course control of spinning rounds.

The use of a Magnetically Actuated Friction (MA) brake or a Magneto-Rheological (MR) fluid brake in conjunction with an external aerosurface as described in U.S. Pat. No. 7,412,930 "Frictional Roll Control Apparatus for a Spinning Projectile," describes a low weight and low power consumption method for de-spinning and orienting the guidance section of a projectile, but fails to provide a trajectory modification method that utilizes a drag device or that utilizes a drag device in conjunction with a spin controlling method.

An electro-mechanical device can be used instead of the MA or MR brake. However, the electro-mechanical device alone would need to be large to overcome the rotational inertia of the spinning guidance section thereby requiring large amounts of power for de-spinning and orienting the guidance section of a projectile.

The use of a drag device in conjunction with the electro-mechanical device to provide the impetus to the projectile for course correction eliminates the need for a costly, weighty and power demanding system for de-spinning and orienting the guidance section of a projectile.

In addition there is a need for an invention that provides trajectory control by the "bank-to-steer" method allowing the effective course control of spinning and non-spinning rounds.

In U.S. Pat. No. 5,425,514 "Modular Aerodynamic Gyrodynamic Intelligent Controlled Projectile and Method of Operating Same," Grosso describes as an alternative embodiment a method similar to the proposed invention however this alternative is not claimed as part of this invention. The author only specifically claims "a thrust rocket to provide a constant thrust vector in a lateral direction". Grosso does not claim aero-surfaces as the thrust vector generator as is proposed in this invention.

In U.S. Pat. No. 4,565,340 "Guided Projectile Flight Control Fin System," Bains describes a method for controlling the orientation the trajectory of a projectile using a set of motors to de-spin a guidance fin assembly that is then translated and pivoted to provide course correction. The proposed invention is simpler because it just rotates a guidance collar to provide the necessary force vectoring for course correction and requires only a braking mechanism, not a motor, to de-spin and reorient the guidance collar.

In U.S. Pat. No. 6,135,387 "Method for Autonomous Guidance of a Spin-Stabilized Artillery Projectile and Autonomously Guided Artillery Projectile for Realizing This Method," Seidel, et al. describes an invention that provides a course correction by de-spinning the entire round and then guiding it with the use of actuated canards. Seidel de-spins the entire round using fins and brakes with a parachute and braking fins. The proposed invention is smaller, only de-spins the guidance collar and uses a MA or MR brake and aerodynamic forces to execute guidance. The proposed invention can be retrofitted to existing rounds whereas Seidel's invention cannot. The plurality of fins and a parachute along with various stages and an actuated guidance method make this invention wholly different from the proposed invention.

The use of non-actuated or "fixed" drag device to provide the impetus to a projectile for course correction eliminates the need for a costly, weighty and power demanding system.

The solutions described herein have the advantage of a very small, low power method of roll control for a guidance section and the absence of control actuators on the drag device reduces power consumption, cost and complexity.

BRIEF SUMMARY OF THE INVENTION

The present invention is an apparatus and method for controlling the trajectory of a projectile. In one embodiment, the projectile includes two sections decoupled about a roll axis. A first section or body of the projectile may contain a navigation system that can determine the trajectory of the projectile relative to an Earth inertial frame of reference. Another section or guidance section may have external aero-surfaces which can provide a torque counter to the rotation of the first section. The spin may be provided to the first section by means including gun rifling or an externally applied torque.

In another embodiment of the invention, transverse or yaw trajectory correction may be made. In yet another embodiment, the transverse or yaw trajectory correction may be performed by modulating the torque of the guidance section. In still another embodiment, the torque of the guidance section is modified by a brake. In yet another embodiment, the MA or MR brake is capable of reducing the overall spin of the projectile. In still another embodiment, the reduction in spin of the overall projectile affects the yaw of repose thereby altering the associated side force and thus the trajectory of the projectile. In still another embodiment, an increase in spin is imparted upon the projectile. In yet still another embodiment, the spin is increased by modulating the body collar to a spin rate with a decrease in torque imparted to the projectile. In still another embodiment of the invention, spin strakes are attached to the first section to impart torque to the projectile and to increase projectile spin.

In another embodiment of the invention, forward/aft and/or pitch correction is imparted upon the projectile. In still another embodiment, a drag device can be extended from the first section into an airstream emanating from the moving projectile.

In still another embodiment, several elements discussed herein each and in combination with one another affect the trajectory of the projectile in a known manner and thus can be used to determine course trajectory modification to the projectile.

In yet another embodiment, the first section may contain a navigation system that can determine the trajectory and orientation of the projectile relative to an Earth inertial frame of reference. The guidance section may have external aero-surfaces which can provide a torque counter to the rotation of the first section.

In still another embodiment, the guidance section has one or more asymmetric drag devices, which may be fixed or deployable. In still another embodiment, the drag devices generate a yaw, pitch or combination moment about the axis of the projectile.

In another embodiment, trajectory correction may be made. In yet another embodiment, the guidance section is brought to 0 Hz relative to an Earth inertial frame from its initial rotational speed. In still another embodiment, the guidance section is brought to 0 Hz using a MA Brake or a MR brake such that the overall spin is reduced. In yet another embodiment, the relative spin of the guidance section may be brought down to 0 Hz in an orientation. In still another embodiment, the brake is used in conjunction with on-board sensors such as a magnetometer or light sensor, that positions the one or more drag devices in a desired orientation.

In still another embodiment, after course correction is no longer desired, the guidance section may be enabled to spin. In yet another embodiment, the enablement to spin is provided by external aero-surfaces. In yet another embodiment, the spin may be brought to a rate where the one or more drag devices does not appreciably perturb the trajectory of the projectile.

The inventions described herein provide an apparatus, method and system for a very small, low power method of roll control for a guidance section.

The inventions described herein also provide for an absence of control actuators on a drag device thereby reducing power consumption, cost and complexity.

BRIEF DESCRIPTION OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

The invention disclosed herein could be applied to many different types of projectiles including but not limited to the 60 mm, 81 mm and 120 mm mortar rounds, artillery rounds such as the 105 mm and 155 mm round and the 2.75" Hydra Rocket. The invention incorporates a Roll Control Device (RCD). The invention may incorporate an electronic navigation system, such as a Global Positioning System (GPS) or Inertial Navigation System (INS) or a combination of navigation systems.

Figure 1:
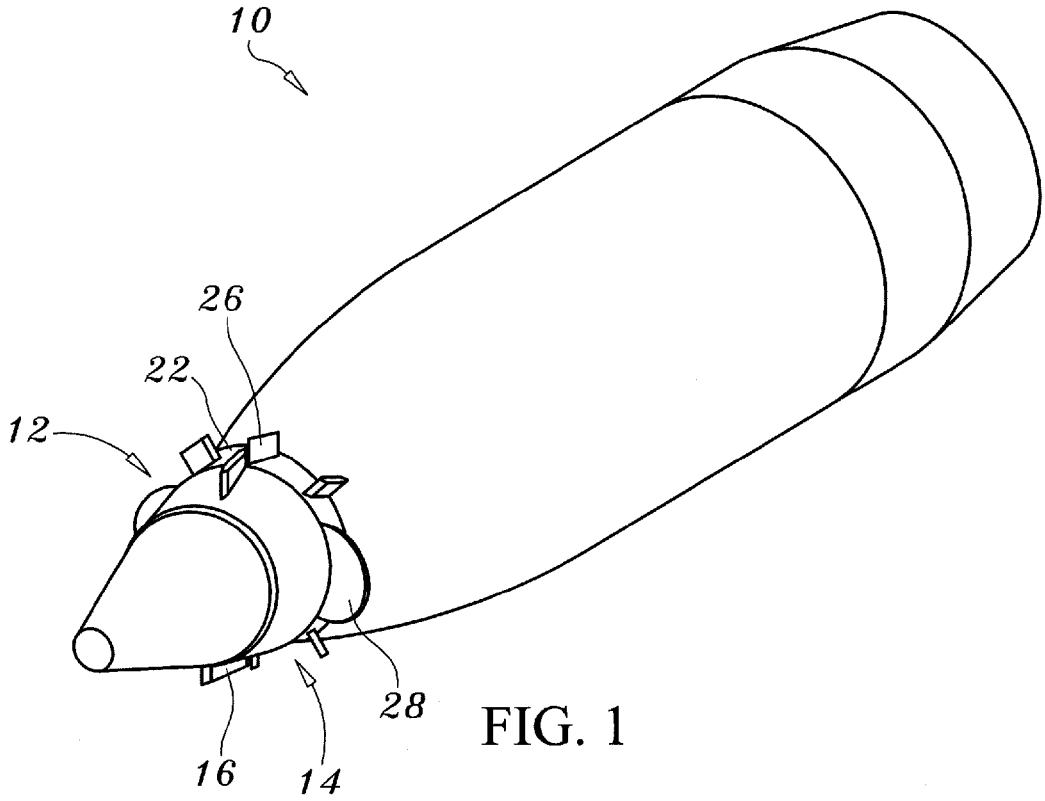
FIG. 1 illustrates a perspective view of a projectile having one embodiment of a guidance kit embodying the invention.
Figure 2:
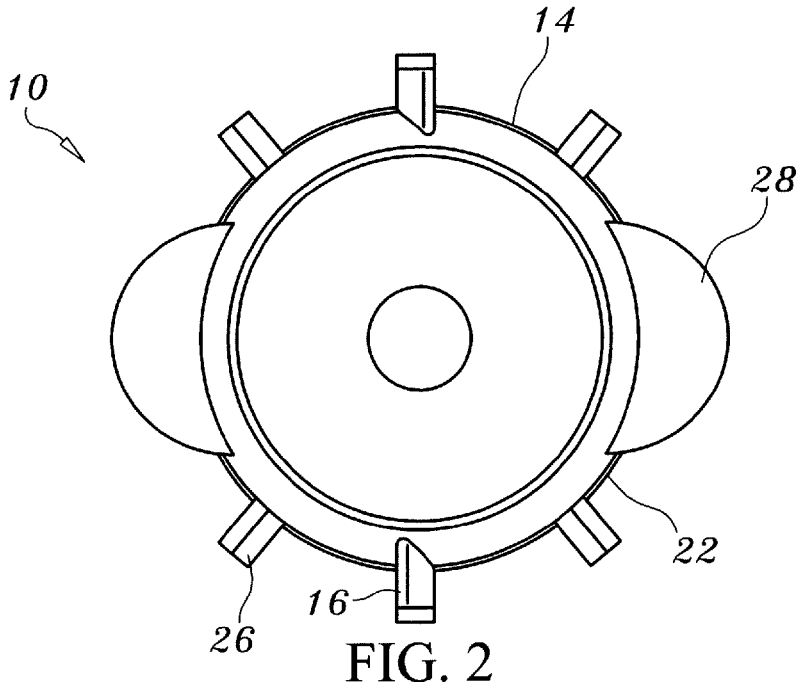
FIG. 2 illustrates a top plan view of a projectile having one embodiment of a guidance kit.
Figure 3:
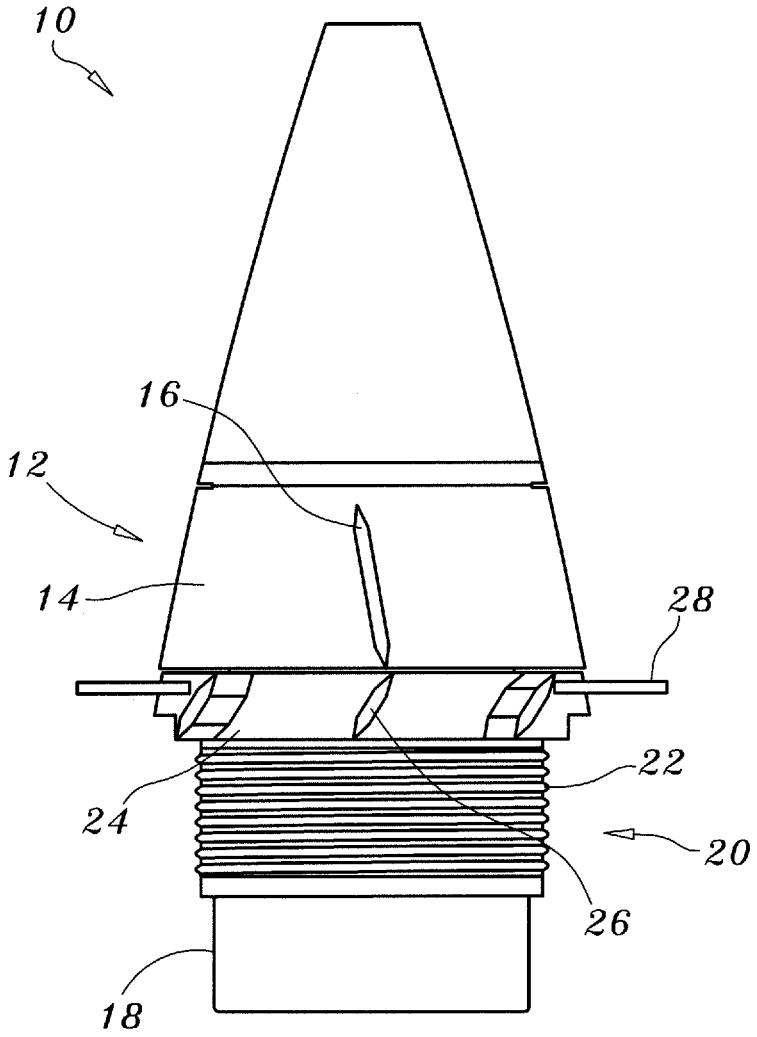
FIG. 3 illustrates a detail of a side view of a guidance kit embodiment of the invention.
Figure 4:
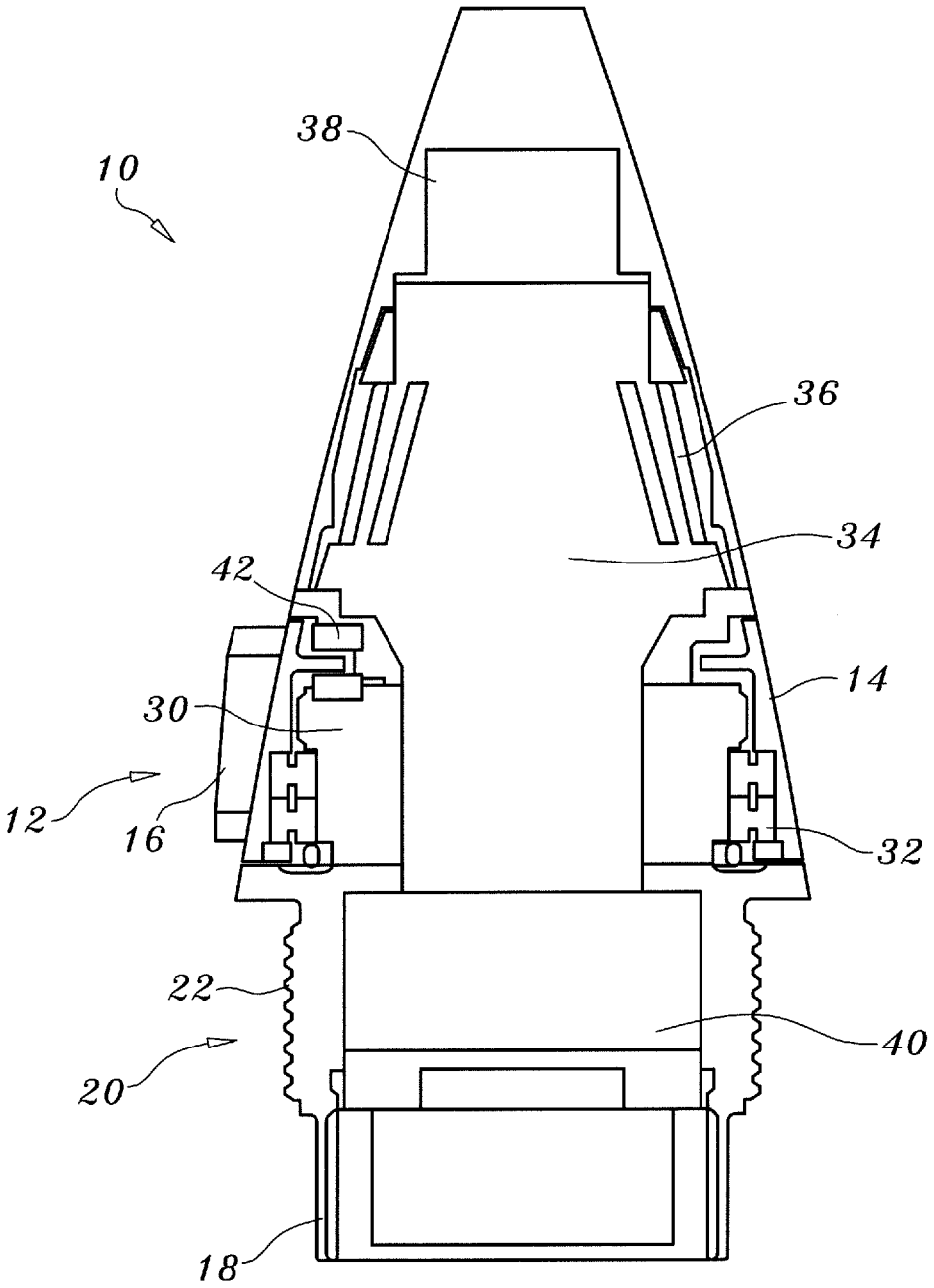
FIG. 4 illustrates a cutout schematic view of a guidance kit embodiment of the invention.
Figure 5:
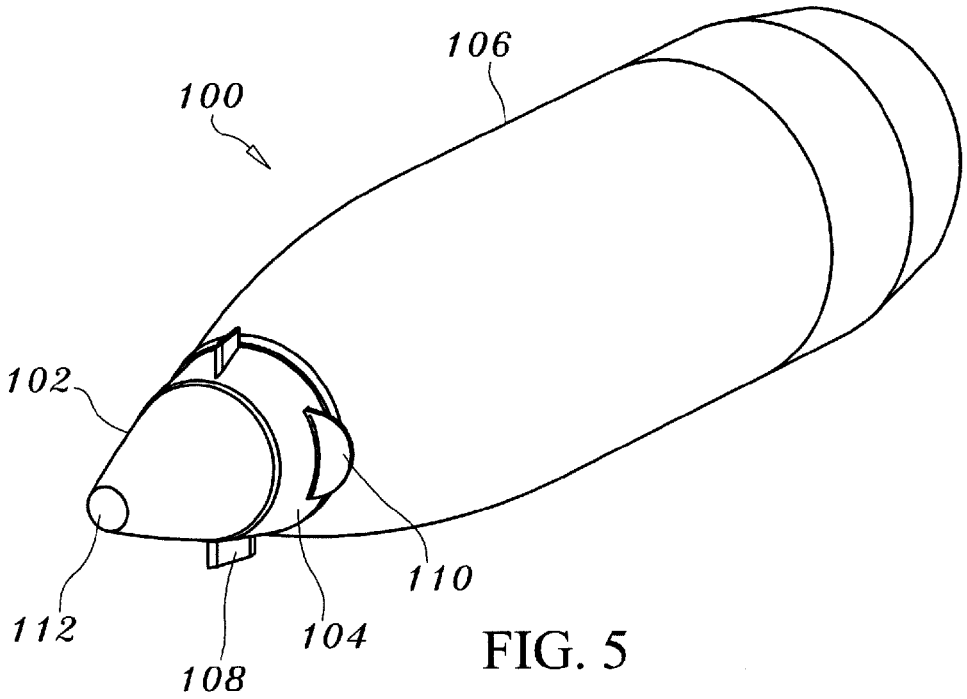
FIG. 5 illustrates a perspective view of an alternative embodiment of a projectile having a guidance kit embodiment of the invention.
Figure 6:
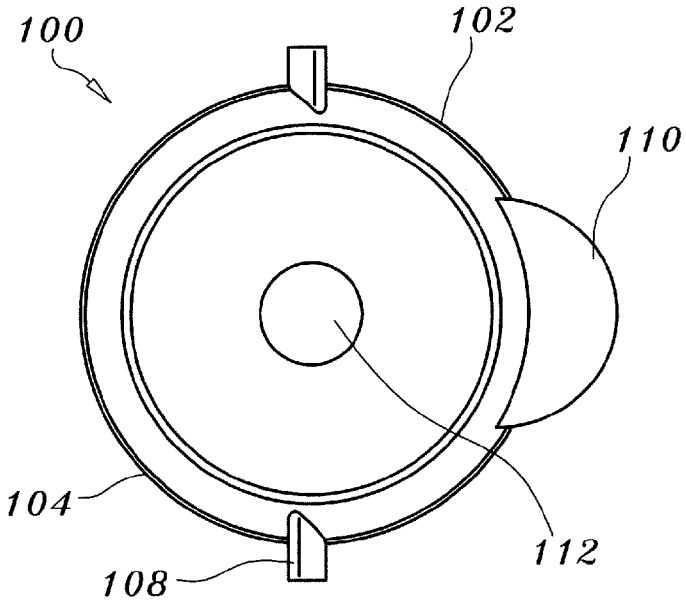
FIG. 6 illustrates a top plan view of an alternative embodiment of a guidance kit embodiment of the invention.
Figure 7:
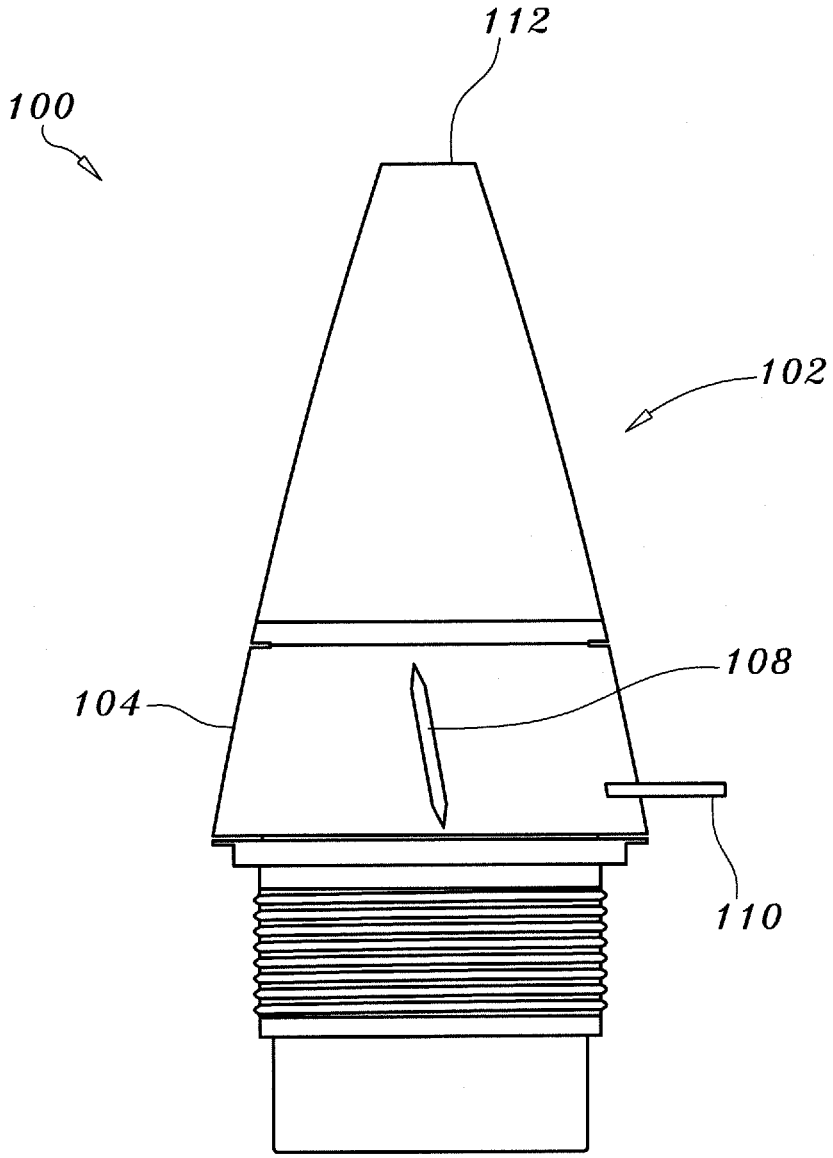
FIG. 7 illustrates a detail of a side view of an alternative embodiment of a guidance kit of the invention.

One embodiment of the invention is shown in FIGS. 1-4. A projectile such as a 105 mm round incorporating the invention is shown generally at 10 in FIGS. 1 and 2. The RCD 12 includes a rotating guidance collar 14. The guidance collar may be located near a front end of the projectile 10 or near an aft end of the projectile. The collar 14 is rotatably attached to the projectile 10. The guidance collar 14 may have one or more externally mounted guidance collar aero-surfaces 16 such as strakes; however, other guidance collar aero-control surfaces may be used. As shown in FIGS. 3 and 4, the projectile 10 may include a base 18 having a connector element 20. The connector element 20 may have a threaded portion 22 for attachment of one or more devices to the base 18. A body collar 24 may be connected to the base 18 at the connector element 20. The body collar 24 may be located fore or aft of the guidance collar 14 on the projectile 10, but it may be preferred to have the body collar 24 located aft of the guidance collar 14. The body collar 24 may be fixed relative to the base 18. The body collar 24 may have one or more body collar aero-surfaces 26. The body collar aero-surfaces 26 may be strakes or may be other suitable configurations. Alternatively, or in addition to the body collar aero-surfaces 26, the body collar 24 may include one or more drag devices 28. The drag devices 28 generate a yaw, pitch or combination moment about the axis of the projectile 10. The drag devices 28 may be fixed or may be deployable by spring, spin, setback forces or other mechanical forces, electronic, pyrotechnical, or equivalent means. The body collar may also have a combination of fixed and deployable drag devices. For the embodiments shown in FIGS. 1-4, the preferred embodiment for the drag devices 28 to be deployable.

The one or more drag devices 28 may be symmetrical or asymmetrical in shape, and several drag devices may form a symmetrical or asymmetrical shape. For the embodiment shown in FIGS. 1-4, a symmetrical shape and symmetrical configuration for the drag devices 28 is preferred. A drag device 28 as described in this application may be any element that produces a change in the pressure distribution on the projectile 10. Elements such as protuberances or dimpling that change the boundary layer around the projectile from laminar to turbulent or turbulent to laminar can affect localized pressure distribution. Also, elements that produce area drag such as a plate or rod extending into the air flow around the projectile may also create a localized pressure distribution change. Furthermore, elements that produce skin friction drag such as surface roughness, surface holes and rippling also change the pressure distribution. Also, diversion of the air flow around the projectile by using elements such as a channel or tube may also create a localized pressure distribution change.

Housed within the RCD 12 may be a number of components used to guide the projectile 10 to a target. As shown in FIG. 4, a brake 30 may be housed within the RCD 12. The brake 30 may be a magnetically actuated (MA) friction brake, a magneto-rheological fluid (MR) brake, or other appropriate brake or braking system known in the art. In addition, bearings 32 or other elements may be located at an interface between the guidance collar 14 and the base 18. The RCD 12 may include guidance electronics 34. The guidance electronics 34 may have the ability to discern its orientation relative to an Earth inertial reference frame using a navigation system such as GPS or INS or a combination navigation system. Any required antenna 36 such as a GPS antenna may also be located within the RCD 12 and would be in electronic connection with the guidance electronics 34. This configuration is especially preferred in the embodiment shown in FIGS. 1-4 wherein the drag device 28 is deployable.

Electrical energy may be required for features on the projectile 10 such as the brake 30. The brake 30 may require approximately 1 amp at 1.25 V for use of a MA brake. Electrical energy may also be required for sensors 38 as may be desired such as a height-of burst sensor. The electronics may be powered by an on-board power source such as a battery 40. The drag device 28, if deployable, may also require energy for its deployment. The energy for deployment may be imparted as described above. Also, an optical encoder 42 may establish the position of the guidance collar 14 relative to the guidance electronics 34 which are affixed to the projectile 10. The guidance electronics 34 may be able to discern its orientation relative to an Earth inertial reference frame using means such as Global Positioning and an up-down sensor such as a magnetometer or the equivalent.

The guidance electronics 34 may also control a brake 30 that modulates the spin of the aero-surfaces of the guidance collar 14 that produces torque in the opposite direction to the spin of the projectile. This can change the overall spin of the projectile 10. The change of overall spin may change the yaw of repose creating a change in the side forces generated by this phenomenon. Deployable drag devices 28 further modify the airborne characteristics including the range of the projectile.

Another embodiment is generally shown for a projectile at 100 in FIGS. 5-8.

Figure 8:
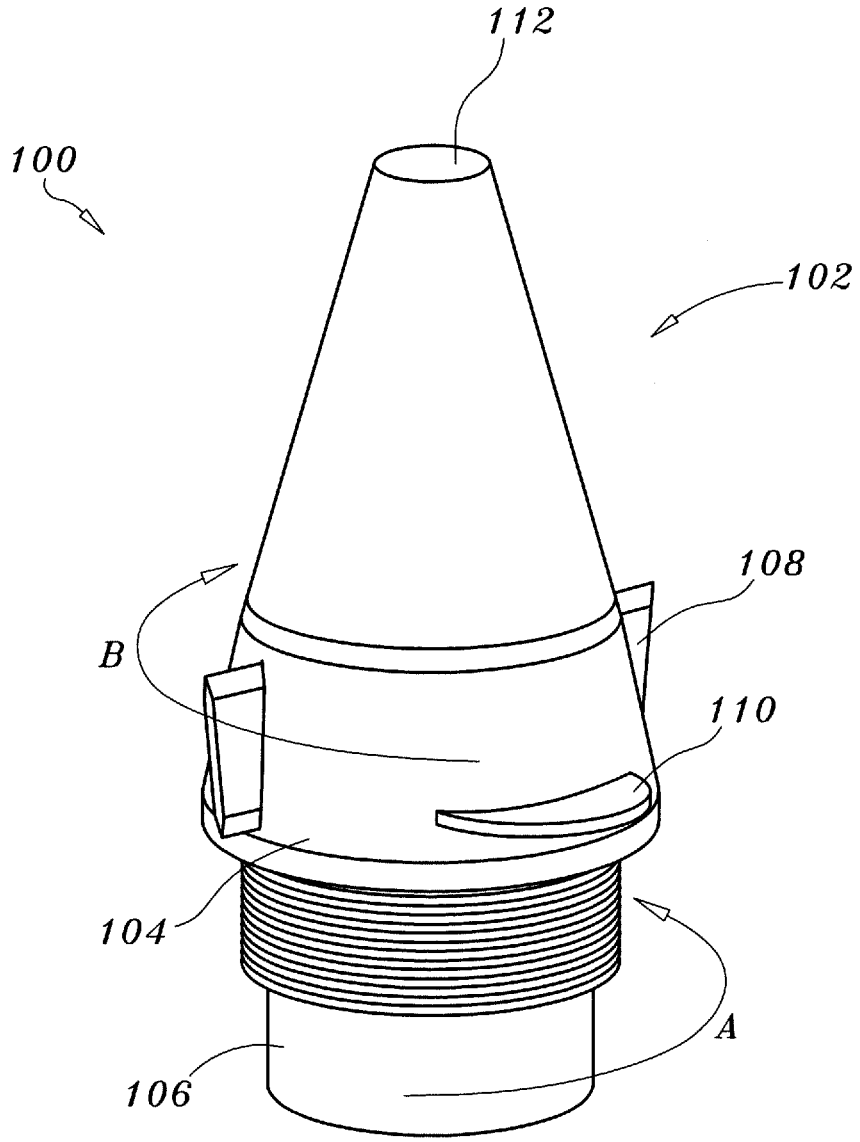
FIG. 8 illustrates a perspective view of an alternative embodiment of a guidance kit embodiment of the invention.

As shown, the RCD 102 includes a guidance collar 104 that is rotatably connected to the base 106 of the projectile 100. The guidance collar 104 may have external aero-surfaces 108 which provide a torque counter to the rotation of the base 106. The guidance collar 104 also may include one or more drag devices 110. The drag devices 110 may be deployable or fixed on the guidance collar 104. The drag devices 110 generate a yaw, pitch or combination moment about the axis of the projectile 100. The drag devices 110 may be also asymmetrical as shown, and they may be asymmetrical in shape or distribution. The drag devices 110 also may change the boundary layer around the projectile 100 from laminar to turbulent or turbulent to laminar as described above. The RCD 102 may also include guidance components such as the guidance electronics described in the earlier embodiment. A guidance system within the RCD 102 may control a drag device (fixed or deployable) that provides a force to execute course correction of the projectile 100. As shown in FIG. 8, the spin direction A of the base 106 is counter to the torque B of the guidance collar 104.

A brake and associated bearings may be at the interface between the freely rotating guidance collar 104 and the base 106.

In an alternative embodiment, the guidance collar 14 may partially or fully enclose the nose of the projectile. The guidance collar 14 may then have an asymmetrical shape relative to the axis of the projectile. The asymmetry of the guidance collar 14 can be rotated to a position to affect a pressure distribution change and thus an asymmetric pressure distribution change that allows a change in the projectile's path.

Use of the Invention

In using one embodiment of the invention, the projectile 10 of the invention exits a gun barrel. Generally, the rotational speed of a projectile 10 is approximately 210 Hz. Both the guidance collar 14 and the projectile base 18 are initially rotating at approximately this speed. The externally mounted aero-surfaces on the guidance collar 14 immediately start applying torque to the guidance collar 14, counter to the rotation of the projectile base 18.

For example, for an embodiment used with a 105 mm round, the torque on the guidance collar 14 may be approximately 0.05 Nm.

In using another embodiment of the invention, when trajectory correction is determined to be needed, the rotational spin of the guidance collar 104 is lowered and may be brought to 0 Hz relative to an Earth inertial frame from its initial rotational speed using aero-surfaces 108. The RCD 102 may be brought to 0 Hz relative spin in an orientation, as determined by guidance electronics such as on-board sensors (magnetometer or light sensor for example), that positions the drag devices 110 in the desired orientation to produce a yaw or pitch moment about the axis of the projectile 100 turning it into the desired direction.

Thus, when course correction is no longer desired, the guidance collar 104 may be allowed to spin using its guidance collar aero-surfaces 108 to a rate where the drag devices 110 do not appreciably perturb the trajectory of the projectile 100. This embodiment provides a method of roll control for a guidance section, and the absence of control actuators on the drag device reduces power consumption, cost and complexity.

A short time after exiting the gun muzzle, the guidance collar 104 spin rate approaches the point where the angular rate relative to the projectile base 106 will change sign. Prior to this point, a MA or MR brake may be activated to slow the rotational speed of the guidance collar 104 and the nose 112 down to 0 Hz relative to the base.

When trajectory correction is desired the guidance collar 104 is oriented by modulating the braking torque, allowing the torque of the aero-surfaces 108 to rotate the drag device 110 toward an orientation affecting a maneuver. The aero-surfaces 108 balance with frictional forces on the projectile 100 and a stable orientation relative to the Earth inertial reference frame is maintained.

Figure 9:
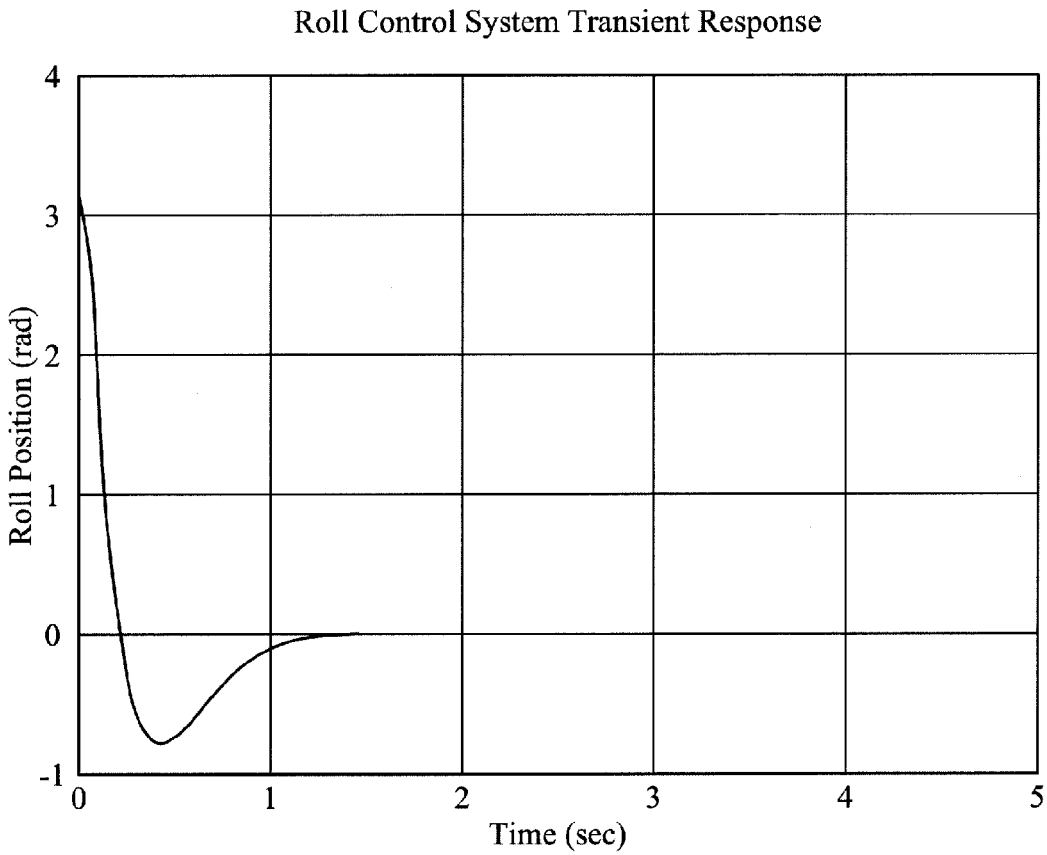
FIG. 9 illustrates an graph for the roll control system of the present invention showing the roll position of the system as a function of time during a reorientation maneuver.

In FIG. 9, the table shown at 200 illustrates the effectiveness of the described invention and shows the roll position transient experienced by the system during a reorientation maneuver associated with initial establishment of local vertical.

Thus, the use of an external torque such as aero-surfaces combined with a brake provides a compact, low power method to de-spin a portion of a spinning projectile or maintain its orientation and allows the de-spun section to be reoriented to provide a bank-to-turn course correction capability.

With regard to roll control there are several alternatives contemplated. While the use of external aero-surfaces is one contemplated method for applying a torque counter to the spin of the projectile base, the torque can come in many forms. Alternate torque sources could be electromechanical, directed ram air, etc.

An alternate form for controlling roll in a projectile is by electro-mechanical means such as a motor. Also, maintaining a low to zero Hz roll and the ability to re-orient a projectile section can be used in conjunction with sensors, cameras or munitions. It is also envisioned that the invention may be used on spin stabilized as well as non-spin stabilized projectiles. For example, the invention may be used with fin stabilized projectiles, especially to execute a bank-to-turn operation.

The trajectory control drag device may be deployed in flight or can be integral to the guidance package. Also, the guidance required to control this method of trajectory modification may come from a variety of methods such as GPS, INS, SAL or radio frequency guidance or their equivalents. These guidance packages and the power for them can be internal or external to the RCD. For example, the RCD may merely include sensors necessary to determine its rotational speed and its orientation relative to the Earth inertial frame. Also, the RCD need not replace the existing fuze element of a projectile but may be captured between it and the projectile. Thus, the existing fuze element may continue to be used.

It will be appreciated by persons skilled in the art that the present invention is not limited to what has been particularly shown and described herein above. In addition, unless mention was made above to the contrary, it should be noted that the accompanying drawings are not to scale. A variety of modifications and variations are possible in light of the above teachings without departing from the scope and spirit of the invention.

What is claimed is:

1. A projectile having a roll control device on the projectile while the projectile is spinning, comprising:

a guidance collar rotatably attached to the projectile, guidance electronics attached to the projectile, wherein the entire guidance collar is rotatable relative to the spin of the projectile, wherein the guidance collar includes one or more guidance collar aero-surfaces shaped to provide a torque counter to the spin of the projectile and wherein the guidance collar further comprises one guidance collar drag device fixed upon the guidance collar making an asymmetrical drag surface on the guidance collar, and wherein the guidance collar rotation is controllable by the guidance electronics.

2. The projectile of claim 1, wherein the guidance collar is located near a front end of the projectile.

3. The projectile of claim 1, wherein the guidance collar is located near an aft end of the projectile.

4. The projectile of claim 1, wherein the guidance collar aero-surfaces are strakes.

5. The projectile of claim 1, wherein the one guidance collar drag device comprises a single, fixed drag device fixedly attached to an outer surface of the guidance collar.

6. The projectile of claim 1, wherein one guidance collar drag device is deployable.

7. The projectile of claim 1, wherein the one guidance collar drag device is controlled by a brake.

8. The projectile of claim 1, wherein the one guidance collar drag device comprises an element that changes the pressure profile around the projectile.

9. The projectile of claim 1, wherein the one or more guidance collar aero-surfaces and the guidance collar drag device are controllable by a braking element located within the roll control device.

10. The projectile of claim 1, wherein the guidance collar drag device comprises an asymmetric shape of the guidance collar.

11. The projectile of claim 1, wherein the guidance collar drag device comprises one or more of the following: a contour on the surface of the guidance collar providing asymmetrical drag and a tube on the surface of the guidance collar that diverts air flow to an interior portion of the tube.

12. The projectile of claim 1, further comprising a body collar fixedly attached to the projectile aft of the guidance collar, wherein the body collar includes one or more body collar aero-surfaces.

13. The projectile of claim 12, wherein the body collar aero-surfaces are strakes.

14. The projectile of claim 12, wherein the body collar further includes one or more body collar drag devices.

15. The projectile of claim 14, wherein one or more of the body collar drag devices are deployable.

16. The projectile of claim 14, wherein all of the body collar drag devices are deployable.

17. The projectile of claim 15, further comprising guidance electronics located in the interior of the roll control device, wherein the body collar drag devices are in electronic communication with the guidance electronics.

18. A trajectory modification system for a projectile, comprising:

a roll control device for providing torque counter to a projectile while the projectile is spinning, including:

a guidance collar rotatably attached to the projectile, guidance electronics attached to the projectile, wherein the guidance collar includes one or more guidance collar aero-surfaces shaped for providing torque counter to a projectile while spinning, wherein the entire guidance collar is rotatable relative to the spin of the projectile, and wherein the guidance collar further comprises one guidance collar drag device fixed upon the guidance collar making an asymmetrical drag surface on the guidance collar, and wherein the guidance collar rotation is controllable by the guidance electronics.

19. The trajectory modification system of claim 18, wherein the guidance collar further located near a front end of the projectile.

20. The trajectory modification system of claim 18, wherein the guidance collar further located near an aft end of the projectile.

21. The trajectory modification system of claim 18, wherein the one guidance collar drag device comprises a single, fixed drag device.

22. The trajectory modification system of claim 18, wherein one more of the guidance collar drag device is deployable.

23. The trajectory modification system of claim 18, wherein the drag device comprises one or more elements that change the boundary layer around at least a portion of the projectile from laminar to turbulent or turbulent to laminar.

24. The trajectory modification system of claim 18, further comprising a body collar fixedly attached to the projectile aft of the guidance collar, wherein the body collar includes one or more body collar aero-surfaces.

25. The trajectory modification system of claim 24, wherein the body collar further includes one or more body collar drag devices.

26. The trajectory modification system of claim 25, wherein one or more of the body collar drag devices are deployable.

27. The trajectory modification system of claim 25, wherein all of the body collar drag devices are deployable.

28. The trajectory modification system of claim 18, wherein the guidance collar drag device comprises an asymmetric shape of the guidance collar.

29. The trajectory modification system of claim 18, wherein the guidance collar drag device comprises one or more of the following: a contour on the surface of the guidance collar providing asymmetrical drag and a tube on the surface of the guidance collar that diverts air flow.

* * * * *